United States Patent [19]

Vollrath et al.

[11] 4,175,893

[45] Nov. 27, 1979

[54] METHOD AND APPARATUS FOR FEEDING A CARDING GROUP WITH PNEUMATIC CONVEYING SYSTEM

[75] Inventors: Ulrich Vollrath, Neuss; Ferdinand Leifeld, Kempen, both of Fed. Rep. of Germany

[73] Assignee: Trutzschler GmbH & Co. KG, Monchengladbach, Fed. Rep. of Germany

[21] Appl. No.: 903,028

[22] Filed: May 4, 1978

[30] Foreign Application Priority Data

May 8, 1977 [DE] Fed. Rep. of Germany ..... 2720340

[51] Int. Cl.[2] ..... B65G 53/36; B65G 53/48; B65G 53/60

[52] U.S. Cl. ..... 406/52; 406/156; 406/171

[58] Field of Search ..... 302/28, 59, 60, 61; 19/105; 209/133, 138, 139 R, 139 A, 140, 141

[56] References Cited

U.S. PATENT DOCUMENTS

| | | | |
|---|---|---|---|
| Re. 27,967 | 4/1974 | Binder et al. | 302/28 X |
| 1,729,341 | 9/1929 | Johnson | 302/60 |
| 1,911,543 | 5/1933 | Bailey | 302/28 |
| 2,187,330 | 1/1940 | Rudd | 302/60 X |
| 2,580,581 | 1/1952 | Niemetz | 302/28 |

FOREIGN PATENT DOCUMENTS

| | | | |
|---|---|---|---|
| 175537 | 7/1953 | Austria | 302/59 |
| 2626972 | 1/1977 | Fed. Rep. of Germany | 302/59 |

*Primary Examiner*—James L. Rowland
*Attorney, Agent, or Firm*—Haseltine, Lake & Waters

[57] ABSTRACT

An arrangement for feeding a carding group with a pneumatic conveying system in which the feeding supplies a plurality of feed chutes. A flake flow is broken up, and is distributed with uniform circular motion, and is then converted into a flake accumulation of rectangular cross-section. The flake flow is distributed by centrifugal force effects, and the flake accumulation may be vertically compressed. A pneumatic conveying duct is followed by at least one feed chute with rectangular exit cross-section, in which an opening and distribution element with circular delivery is located between the conveying duct and the feed chute. The opening and the distribution elements, moreover, operate pneumatically, and may have a cone-shaped outer surface. The rotary speed of the opening and distribution elements may be made continuously variable, and the feed chute may have a circular entry cross-section.

12 Claims, 7 Drawing Figures

METHOD AND APPARATUS FOR FEEDING A CARDING GROUP WITH PNEUMATIC CONVEYING SYSTEM

BACKGROUND OF THE INVENTION

The present invention relates to a method for feeding a carding group with pneumatic conveying system, in which the feeding arrangement supplies a plurality of feed chutes, and apparatus for implementing the method.

With a known method, a transport fan blows fiber flakes through a conveying duct in feed chutes of carding feeders. At each location where a feed is connected to the conveying duct, there is a rectangular opening in the conveying duct; the width of this opening equals the width of the feed chute. The fiber flakes are conveyed through the conveying duct in an irregular manner, i.e., with different volumes per unit time. The fiber flakes drop from the conveying duct through the opening in the feed chute and are deposited there vertically and horizontally distributed at random. For example, if the feed chute is 1 m wide, a larger portion may drop on one end into the opening, and a smaller portion may drop on the other end into the opening so that the accumulation in the feed chute is of varying height. As a result, the flake accumulation across the width exerts a varying pressure on the take-up roller so that a fleece of varying thickness (density) is pulled from the feed chute. In addition, the flakes do not drop in equal quantities into the feed chute so that the flakes accumulation in the feed chute has zones of larger or smaller density; frequently there are areas which have no flakes whatever. With irregular accumulation, under the influence of the excess pressure prevailing in the conveying duct, there may develop an air flow from the top to the bottom which concentrates on the zones of lower density and hence vertically compresses the flakes lying on top of one another. However, this merely compresses the zones of larger and smaller density vertically. The varying height distribution of the flake accumulation is not remedied. However, a uniform flake distribution both within the flake accumulation and over the height of the flakes deposited on top of one another is a decisive factor for the uniformity of the fleece delivered to the cards and thus of the card band.

It is, therefore, an object of the present invention to provide a method of the above type which is free from these disadvantages, and in a simple manner permits uniformity of flake accumulation across the entire cross section of the feed chute.

Another object of the present invention is to provide an arrangement, as described, which is substantially simple in construction and may be economically fabricated.

A further object of the present invention is to provide an arrangement, as described, which may be readily maintained in service, and which has a substantially long operating life.

SUMMARY OF THE INVENTION

The objects of the present invention are achieved by providing that the basic concept of the invention makes use of the uniformity of the circular shape or of an annular ring for the formation of a uniform flake accumulation. For this purpose, the flake flow delivered at randon and irregularly from the pneumatic conveying duct is broken up. Preferably, the flake flow is first deposited in a reservoir so that always equal or nearly equal volume quantities per unit time can be broken up. The breakup is made by distributing the flake flow with a uniform motion on a circular or annular track whose plane preferably is perpendicular to the flake accumulation in the feed chute. It is important that the speed of this movement is dimensioned so that the flake flow is opened during the distribution so that zones of larger or lesser compression can be broken up. In this manner, a uniform distribution of the flake flow is achieved with simultaneous uniformity of the density. Finally, this flake flow is converted in each feed chute into a flake accumulation of rectangular cross-section. The circular or annular motion of the flake flow is converted into a horizontal back and forth motion so that the rectangle shape develops from the circular or annular shape. An advantage is that a stop and start at the reversal locations of the back and forth motion is avoided. The rectangular flake accumulation progresses continually with interference with the motion. In this manner, a uniformity of flake accumulation across the entire cross-section of the feed chute is realized. This flake accumulation has a uniform height distribution and is free from zones of larger and smaller density so that a uniform card band is obtained from the fleece.

A particularly good opening and distribution of the flake flow happens under the effect of centrifugal force. especially when there are many zones of larger and smaller density. The conveying air stream can pass through the flake accumulation and exit at the lower end of the feed chute. When the conveying air stream already exits in the upper region of the feed chute, the flake accumulation can be vertically compressed, for example, by a pump or fan.

The invention also includes a device for implementing the method in accordance with the invention. Between the conveying chute and the feed chute, an opening and distributing element with circular delivery of the opened flakes is located. This opening and distribution element may rotate about a horizontal or vertical axis. The flake flow is delivered in the area of the one end. The air current used for pneumatic transport of the flakes presses the flakes against or into the opening and distribution element and presses the opened and torn-away flakes into the feed chute. The delivery of the opened fiber flakes in the area of the other end has a circular orbit. Particularly under the influence of centrifugal force, the fiber flakes are ejected.

The opening and distribution element may be hollow so that through an opening at one end, a flake quantity enters, is moved along inside and exits again at the other end through an opening. However, if the flake flow is directed on the outside shell surface, the opposite fixed wall surface determines a conveying space for a certain throughput quantity.

When the opening and distribution element is rotary, for example, in the form of a disk, the flake flow can be hurled off by centrifugal force. A conic outer shell has the advantage of an adaptation to the slope (angle) of the shell of the feed chute or the filler element. Finally, the opening and distribution element can be constructed as a rotary spreader with inside twist, with the conveying air current being used as a rotary (twisting) drive.

Preferably, the rotary speed of the opening and distribution element is continuously variable, including the value zero for the rotary speed, i.e., the opening and distribution element can be turned on and off. In this manner, the feed of fiber flakes into the feed chute can be controlled.

If the opening and distribution element revolves about a vertical axis, the feed chute for receiving the opened and distributed fiber flakes has a circular entry cross-section. The shell is shaped so that this circular shape turns into a rectangular exit cross-section; the shell area widens on the side in the direction of the length of the rectangle, in order to avoid the formation of bridging connections between the opened distributed fiber flakes. Also, the radial distribution of the opened fiber flakes is important in order to avoid these bridge formations.

In order to apply a steady flake flow to the opening and distribution element, a reserve tank is placed between the conveying duct and the opening and distribution element. This reserve tank may be a rectangular reserve chute or it may be cylindrical.

To achieve a great flake accumulation height in a rectangular feed chute, a filler element with circular entry and rectangular exit is placed between the reserve tank and the feed chute.

According to another preferred embodiment, the opening and distribution element is aligned coaxially with a rotary conveying element, e.g., a screw conveyor. This provides a steady conveying flow to the opening and distribution element. The conveying element preferably runs at a lower speed than the opening and distribution element, since the conveying element must provide for a uniform feeding of fiber flakes and the opening and distribution element must provide for opening and uniform distribution. The conveying element may run slower or faster, depending on the flake accumulation in the feed chute, while the opening and distribution element independently runs at higher speed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
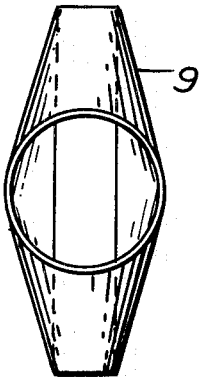
FIG. 2 shows a horizontal section taken along line 11—II in FIG. 1 through the filler element of FIG. 1.

The fiber flakes are sucked-in by a box feeder (not shown) through a duct 1 by a fan 2 which conveys the fiber flakes via a transporting medium, i.e., air, to an elevated conveying duct 3. Vertical feed chutes 4 for cards 5 lined up in a row are connected to the conveying duct 3. The walls of the feed chutes have air vents 6. A cylindrical reserve tank 7 is connected to the conveying duct 3 above each feed chute 4; the fiber flakes from the conveying duct 3 are fed into this tank 7. A filler element 8 is located between the lower end of the reserve tank 7 and the upper end of feed chute 4. The filler element 8 has a circular entry cross-section and a rectangular exit cross-section (see FIG. 2). The shell area 9 increases laterally in the direction of the length of the rectangle. An opening and distribution element 10 is provided in the entry region of the filler element 8 between the reserve tank 7 and the feed chute 4; this element can be rotated about a vertical axis. With proper selection of the flow conditions, the conveying air current can be used as rotary drive for this opening distribution element 10.

During operation, the fiber flakes transfer from the conveying duct 3 into the reserve tanks 7, and are forced by the pneumatic conveying air current onto the one end of the opening and distribution element 10. They are then distributed with uniform circular motion in the circular entry opening of the filler element 8. This opens the fiber flakes. Then the opened fiber flakes are forced by the pneumatic conveying air current against the inner surface 9 and transformed in the direction towards the exit opening of filler element 8 into a rectangular shape. From there the fiber flake accumulation is drawn by moving rollers, located at the lower ends of the feed chutes 4, from the feed chutes 4 and delivered to the carding unit.

Figure 3:
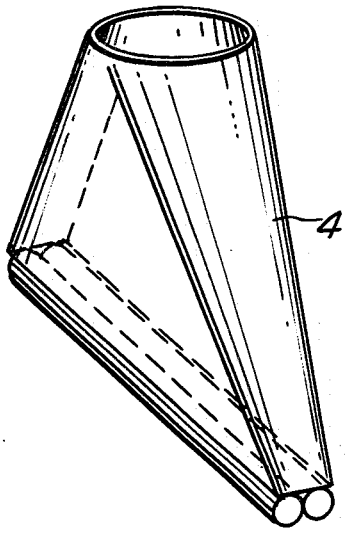
FIG. 3 is a perspective view and shows an embodiment of a feed chute in accordance with the present invention.

FIG. 3 shows an embodiment of feed chute 4 with circular entry cross-section and rectangular exit cross-section. This embodiment is a combination of filler element 8 and of rectangular feed chute 4 of FIG. 1 in one unit.

Figure 1:
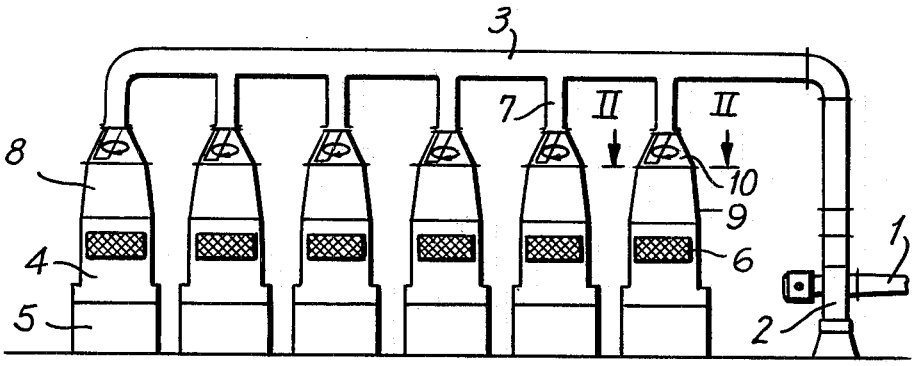
FIG. 1 is a schematic view and shows a front view of an installation for feeding a carding assembly.
Figure 4:
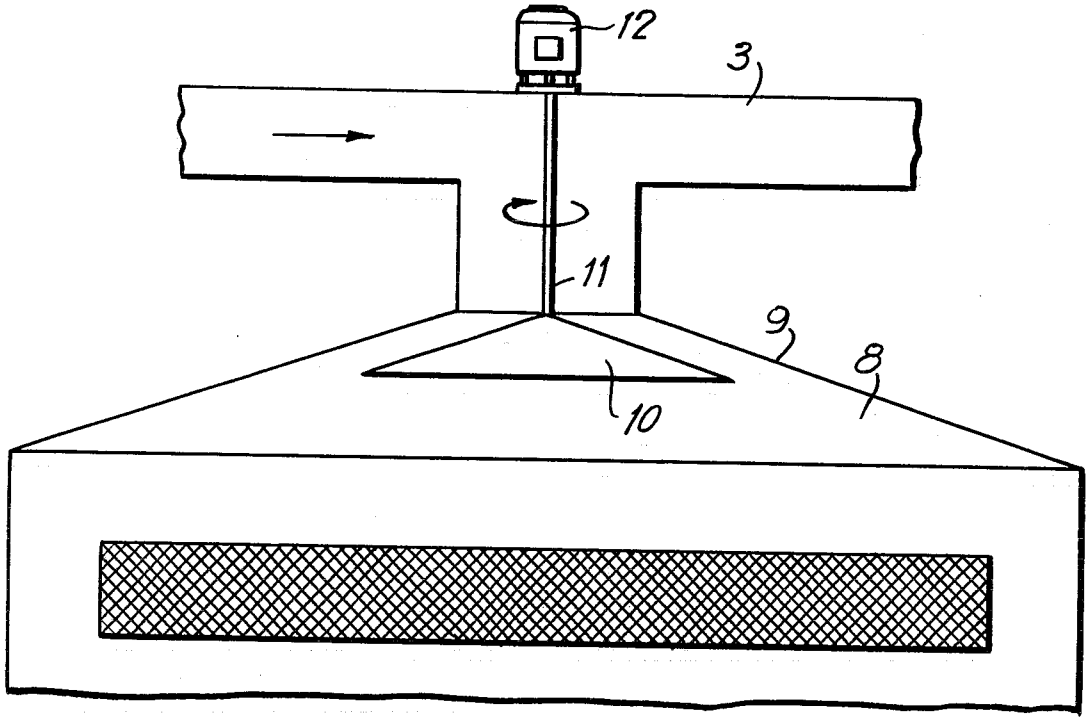
FIG. 4 shows a partial longitudinal section through an installation according to FIG. 1 with a cone-shaped opening and distributor element.

FIG. 4 shows a partial longitudinal section through an installation of FIG. 1 where in the upper region of the filler element, a cone-shaped opening and distributor 10 is located. This opening and distribution element 10 is driven via a shaft 11 by a drive installed outside conveying duct 3, e.g., a motor 12 and rotates at a peripheral speed of about 50 to 70 m/sec. Between the outer surface of the opening and distributor element 10 and the surface 9 of the filler element 8, there is a passage for the fiber flakes.

Figure 5:
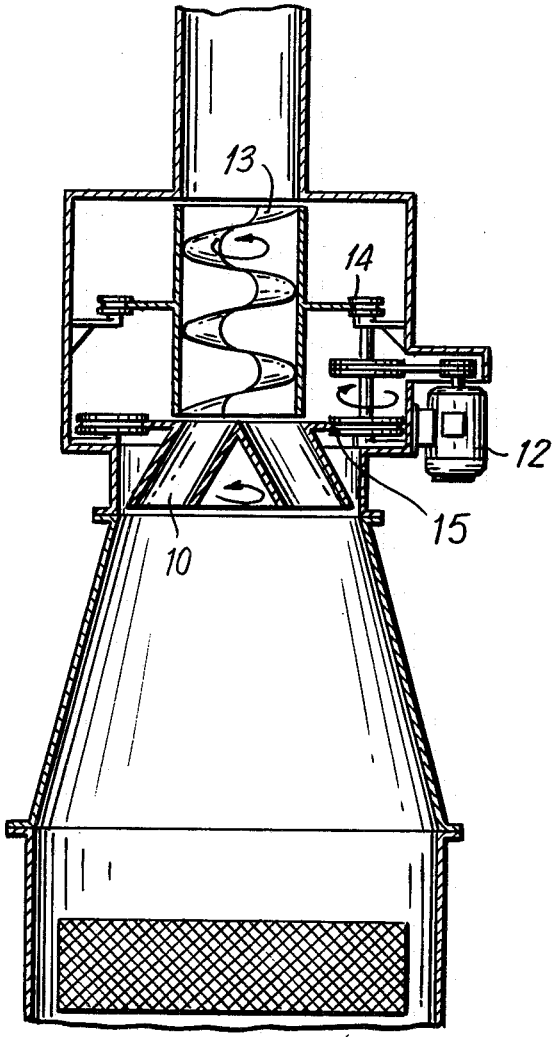
FIG. 5 shows an embodiment of the apparatus with conveying element in accordance with the present invention.

FIG. 5 shows an embodiment where the opening and distributor element 10 is aligned coaxially with a rotary conveying element 13. Both the opening and distribution element 10 and the conveying element 13 are driven via drives 14, 15 by a motor 12.

Figure 6:
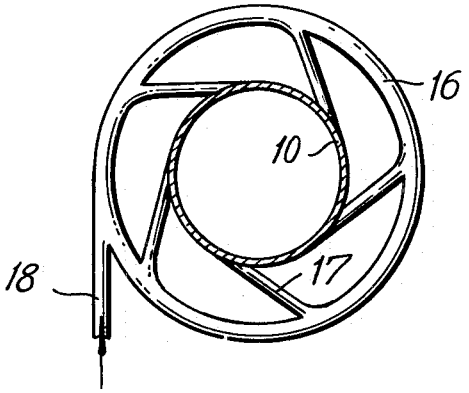
FIGS. 6 and 7 show longitudinal and cross-sections through a pneumatic opening and distributor element.
Figure 7:
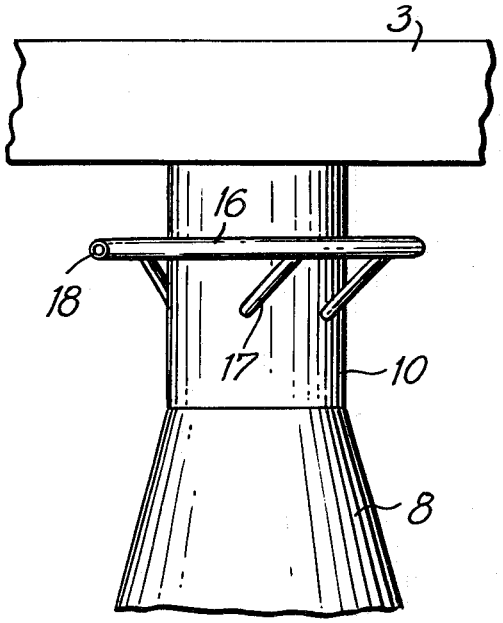

FIG. 6 shows a cross-section through an opening and distribution element 10 operating pneumatically. The cylindrical opening and distribution element 10 has tangentially mounted pipe stubs 17 which are connected to a common compressed-air line 16. The pipe stubs 17 are angled downward (see FIG. 7) and may also be set in a position between tangential and radial.

Compressed air is introduced into the compressed-air line 16 through the pipe connection 18 and from there to each of stubs 17. Because of the tangential and obliquely downward direction, there develops in the opening and distribution element 10 an air current which extends like a spiral in the direction of the chute 8; this air current opens the fiber flakes coming from conveying duct 3 and distributes them over a circular track. In order to open the flakes properly, intermittent air bursts are directed from the pipe connection 18 onto the flakes.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalents of the following claims.

What we claim is:

1. A method for separating fiber flakes from a transporting air stream, particularly for feeding a carding group, comprising the steps of: feeding a plurality of feed chutes; breaking up said fiber flakes for converting compacted fiber flow into substantially loose flakes; distributing the flake flow with uniform circular motion; distributing said fiber flakes in a horizontal plane; pressing said fiber flakes against a cylindrical or cone-shaped inner jacket surface; forming a flake layer with circular cross section; transforming said flake layer into a form of rectangular cross section for producing a flake fill with substantially uniform height distribution and substantially free of regions of heavier and lighter density; depositing said fiber flakes as flake layer of rectangular cross section for providing a uniform carding layer.

2. A method as defined in claim 1, wherein said flake flow is distributed by centrifugal force effects.

3. A method as defined in claim 1, including the steps of compressing vertically said flakes accumulation.

4. Apparatus for carrying out the method according to claim 1, comprising: a plurality of feed chutes to be fed; means for breaking up a flake flow; means for distributing the flake flow with uniform circular motion, means for gradually converting said flake flow inside said feed chute into a flake accumulation of rectangular cross-section; a pneumatic conveying duct; at least one feed chute of rectangular exit cross-section and following said pneumatic conveying duct; opening and distribution means with circular delivery and located on a vertical axis between said pneumatic conveying duct and said feed chute.

5. Apparatus as defined in claim 4, wherein said opening and distribution means is operated pneumatically by tangentially mounted pipe stubs connected to a common compressed-air line.

6. Apparatus as defined in claim 4, wherein said opening and distribution means has a cone-shaped outer surface and a drive installed outside said conveyor duct.

7. Apparatus as defined in claim 4, wherein said opening and distribution means has a continuously variable rotary speed for controlling feed of fiber flakes.

8. Apparatus as defined in claim 4, wherein said feed chute has a circular entry cross-section and a rectangular exit cross-section.

9. Apparatus as defined in claim 4, including a reserve tank between said conveying duct and said opening and distribution means.

10. Apparatus as defined in claim 9, including filler means of circular entry cross-section and rectangular exit cross-section located between said reserve tank and said feed chute.

11. Apparatus as defined in claim 6, including a rotary conveying element aligned coaxially with said opening and distribution means and operated by said drive.

12. Apparatus as defined in claim 4, wherein said opening and distribution means is operated pneumatically by tangentially mounted pipe stubs connected to a common compressed-air line, said opening and distribution means having a cone-shaped outer surface, said opening and distribution means having a continuously variable rotary speed for controlling feed of fiber flakes, said feed chute having a circular entry cross-section and a rectangular exit cross-section, a reserved tank between said conveying duct and said opening and distribution means, filler means of circular entry cross-section and rectangular exit cross-section located between said reserved tank and said feed chute, and a rotary conveying element aligned coaxially with said opening and distribution means.

* * * * *